US010492018B1

(12) United States Patent
Allen

(10) Patent No.: US 10,492,018 B1
(45) Date of Patent: Nov. 26, 2019

(54) SYMMETRIC BINAURAL RENDERING FOR HIGH-ORDER AMBISONICS

(71) Applicant: GOOGLE INC., Mountain View, CA (US)

(72) Inventor: Andrew Allen, San Jose, CA (US)

(73) Assignee: GOOGLE LLC, Mountain View, CA (US)

( * ) Notice: Subject to any disclaimer, the term of this patent is extended or adjusted under 35 U.S.C. 154(b) by 0 days.

(21) Appl. No.: 15/290,717

(22) Filed: Oct. 11, 2016

(51) Int. Cl.

| | |
|---|---|
| ***H04S 1/00*** | (2006.01) |
| ***H04S 3/00*** | (2006.01) |
| ***H04S 7/00*** | (2006.01) |
| ***H04R 5/033*** | (2006.01) |

(52) U.S. Cl.
CPC ..... *H04S 7/304* (2013.01); *H04R 5/033* (2013.01); *H04S 3/008* (2013.01); *H04S 2400/11* (2013.01); *H04S 2420/01* (2013.01); *H04S 2420/11* (2013.01)

(58) Field of Classification Search
CPC ..... H04S 2420/01; H04S 2420/03; H04S 2420/11; H04S 7/30; H04S 1/007; H04S 1/00; G10L 19/008; H04R 5/04
See application file for complete search history.

(56) References Cited

U.S. PATENT DOCUMENTS

| | | | | |
|---|---|---|---|---|
| 5,761,315 | A * | 6/1998 | Iida | H04S 7/302 381/1 |
| 9,101,299 | B2 | 8/2015 | Anderson | |
| 9,215,544 | B2 * | 12/2015 | Faure | H04S 1/00 |
| 9,332,360 | B2 | 5/2016 | Edwards | |
| 9,420,393 | B2 | 8/2016 | Morrell et al. | |
| 9,584,934 | B2 | 2/2017 | Kim et al. | |
| 10,009,704 | B1 | 6/2018 | Allen | |
| 2008/0031462 | A1 | 2/2008 | Walsh et al. | |
| 2009/0116657 | A1 | 5/2009 | Edwards et al. | |
| 2013/0064375 | A1 | 3/2013 | Atkins et al. | |
| 2014/0355794 | A1 | 12/2014 | Sen et al. | |
| 2016/0029144 | A1 | 1/2016 | Cartwright et al. | |
| 2016/0219388 | A1 | 7/2016 | Oh et al. | |

OTHER PUBLICATIONS

Rafaely, Boaz. Fundamentals of Spherical Array Processing, Springer Berlin Heidelberg, 2015, Chapter 1, pp. 1-30.*

(Continued)

*Primary Examiner* — Kile O Blair

(74) *Attorney, Agent, or Firm* — Brake Hughes Bellermann LLP

(57) ABSTRACT

Techniques of performing binaural rendering involve combining left and right HRTFs from speakers symmetrically placed with respect to a forward axis of a listener's head. Because of the symmetry of the listening geometry, a decoded loudspeaker signal resulting from each speaker may be decomposed into symmetric and antisymmetric components according to whether a spherical harmonic associated with a respective ambisonic channel is symmetric or antisymmetric about the forward axis. The result involves rendering the left and right headphone speakers using the same sum and difference HRTFs rather than a different pair of HRFTs for each headphone speaker.

16 Claims, 4 Drawing Sheets

(56) References Cited

OTHER PUBLICATIONS

Politis, Archontis & Poirier-Quinot, David. (Sep. 23, 2016). JSAmbisonics: A Web Audio library for interactive spatial sound processing on the web.*
"Transitive", Merriam Webster.*
"Transitory", Merriam Webster.*
International Search Report and Written Opinion for International Application PCT/US2017/067642, dated Mar. 2, 2018, 13 pages.

* cited by examiner

SYMMETRIC BINAURAL RENDERING FOR HIGH-ORDER AMBISONICS

TECHNICAL FIELD

This description relates to binaural rendering of sound fields in virtual reality (VR) and similar environments.

BACKGROUND

Ambisonics is a full-sphere surround sound technique: in addition to the horizontal plane, it covers sound sources above and below the listener. Unlike other multichannel surround formats, its transmission channels do not carry speaker signals. Instead, they contain a speaker-independent representation of a sound field called B-format, which is then decoded to the listener's speaker setup. This extra step allows the producer to think in terms of source directions rather than loudspeaker positions, and offers the listener a considerable degree of flexibility as to the layout and number of speakers used for playback.

In ambisonics, an array of virtual loudspeakers surrounding a listener generates a sound field by decoding a sound file encoded in a scheme known as B-format from a sound source that is isotropically recorded. The sound field generated at the array of virtual loudspeakers can reproduce the effect of the sound source from any vantage point relative to the listener. Such decoding can be used in the delivery of audio through headphone speakers in Virtual Reality (VR) systems. Binaurally rendered high-order ambisonics (HOA) refers to the creation of many (e.g., at least 9) virtual loudspeakers which combine to provide a pair of signals to left and right headphone speakers. Frequently, such rendering takes into account the effect of a human auditory system using a set of Head Related Transfer Functions (HRTFs). Performing convolutions on signals from each loudspeaker with the set of HRTFs provides the listener with a faithful reproduction of the sound source.

SUMMARY

In one general aspect, a method can include receiving sound data indicating a sound field that has (i) a first component that is symmetric about a forward axis of a head of the human listener and (ii) a second component that is antisymmetric about the forward axis. The method can also include acquiring a left head-related transfer function (HRTF) corresponding to a left ear of the head and a right HRTF corresponding to a right ear of the head. The method can further include generating (i) a difference HRTF as a difference between the left HRTF and the right HRTF and (ii) a sum HRTF as a sum of the left HRTF and the right HRTF. The method can further include performing (i) a first convolution operation on the first component of the sound field with the sum HRTF to produce a sum field and (ii) a second convolution operation on the second component of the sound field with the difference HRTF to produce a difference field. The method can further include rendering the sound fields for presentation to the left ear and the right ear based on the sum field and the difference field.

The details of one or more implementations are set forth in the accompanying drawings and the description below. Other features will be apparent from the description and drawings, and from the claims.

DETAILED DESCRIPTION

Conventional approaches to performing binaural rendering involve performing 2 convolutions per loudspeaker signal, i.e., a convolution of a HRTF with a decoded signal for that loudspeaker. Along these lines, in rendering third-order ambisonics, there are 16 loudspeakers to which a 16-channel B-format input is decoded. Taking the sample rate for VR audio to be 48 kHz and the size of a block on which convolutions are performed to be 1024, there are about 47 blocks per second that will be processed for each loudspeaker. Thus, there are 1024*2 signals per loudspeaker (left and right)*2 convolutions, which is 4096 operations per loudspeaker per block. This in turn amounts to 4096*16 loudspeakers*47 blocks=3,080,192 operations per second to render VR audio. It is desirable to reduce the computational burden in binaural rendering for VR systems without introducing losses or distortions in the rendered sound.

In accordance with the implementations described herein and in contrast with the above-described conventional approaches to performing binaural rendering, improved techniques involve combining left and right HRTFs from speakers symmetrically placed with respect to a forward axis of a listener's head. Because of the symmetry of the listening geometry, a decoded loudspeaker signal resulting from each speaker may be decomposed into symmetric and antisymmetric components according to whether a spherical harmonic associated with a respective ambisonic channel is symmetric or antisymmetric about the forward axis. The result involves rendering the left and right headphone speakers using the same sum and difference HRTFs rather than a different pair of HRTFs for each headphone speaker.

Advantageously, by taking advantage of the symmetry in the VR environment as well as the inherent symmetries and antisymmetries of the spherical harmonics used to represent the decoded loudspeaker signals, the number of convolutions per ambisonic channel may be reduced from two per channel to one. This reduction in computation is accomplished without introducing any loss mechanisms such as truncation. Such a lossless reduction in computation is important because less and less space is being allotted to audio rendering in VR computing owing to increased resources needed for graphics.

Figure 1:
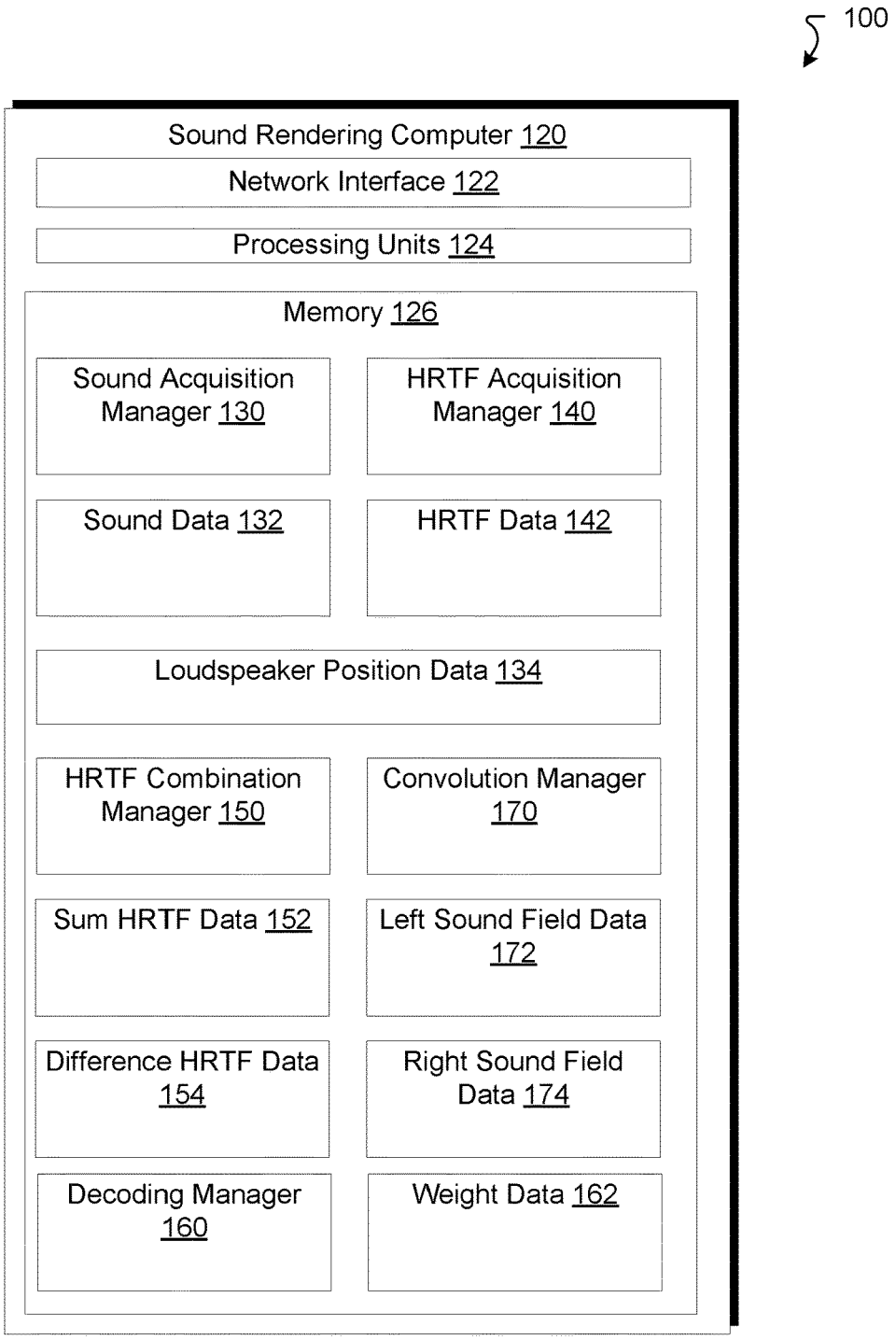
FIG. 1 is a diagram that illustrates an example electronic environment for implementing improved techniques described herein.

FIG. 1 is a diagram that illustrates an example electronic environment 100 in which the above-described improved techniques may be implemented. As shown, in FIG. 1, the example electronic environment 100 includes a sound rendering computer 120.

The sound rendering computer 120 is configured to render sound fields for presentation to a left ear and a right ear of a head of a human listener. The sound rendering computer 120 includes a network interface 122, one or more processing units 124, and memory 126. The network interface 122 includes, for example, Ethernet adaptors, Token Ring adaptors, and the like, for converting electronic and/or optical signals received from the network 170 to electronic form for use by the point cloud compression computer 120. The set of processing units 124 include one or more processing chips and/or assemblies. The memory 126 includes both volatile memory (e.g., RAM) and non-volatile memory, such as one or more ROMs, disk drives, solid state drives, and the like. The set of processing units 124 and the memory 126 together form control circuitry, which is configured and arranged to carry out various methods and functions as described herein.

In some embodiments, one or more of the components of the sound rendering computer 120 can be, or can include processors (e.g., processing units 124) configured to process instructions stored in the memory 126. Examples of such instructions as depicted in FIG. 1 include a sound acquisition manager 130, a HRTF acquisition manager 140, a HRTF combination manager 150, a decoding manager 160, and a convolution manager 170. Further, as illustrated in FIG. 1, the memory 126 is configured to store various data, which is described with respect to the respective managers that use such data.

The sound acquisition manager 130 is configured to acquire sound data 132 from various sources. For example, the sound acquisition manager 130 may the sound data 132 from an optical drive or over the network interface 122. Once it acquires the sound data 132, the sound acquisition manager is also configured to store the sound data 132 in memory 126. In some implementations, the sound acquisition manager 130 streams the sound data 132 over the network interface 122.

In some implementations, the sound data 132 is encoded in B-format, or first-order ambisonics with four components, or ambisonic channels. In other implementations, the sound data 132 is encoded in higher-order ambisonics, e.g., to order N. In this case, there will be $(N+1)^2$ ambisonic channels.

The HRTF acquisition manager 140 is configured to acquire a pair of HRTFs from each loudspeaker positioned about the listener according to the loudspeaker position data 134. For example, at some earlier time, the HRTF may measure left and right HRTF data 142 for each loudspeaker for a given listener. In some implementations, the HRTF acquisition manager 140 measures a left and right head-related impulse responses (HRIRs) over time and derives the left and right HRTF data 142 from the left and right HRIRs through Fourier transformation.

The HRTF combination manager 150 is configured to combine left and right HRTFs from symmetrically-placed loudspeaker pairs to produce sum HRTF data 152 and difference HRTF data 154. Along these lines, each loudspeaker placed around the listener according to the loudspeaker position data 134 is associated with a left HRTF and a right HRTF. For each symmetrically-placed pair of loudspeakers, the HRTF combination manager 150 stores a sum of the left and right HRTF data from one loudspeaker of the pair as the sum HRTF data 152. In a similar vein, the HRTF combination manager 150 stores a difference between the left and right HRTF data from that loudspeaker as the difference HRTF data 154. Each symmetrically-placed pair of loudspeakers may contribute respective sum HRTF data 152 and difference HRTF data 154.

The decoding manager 160 is configured to decode the sound data 132 acquired by the sound acquisition manager 130 to produce, as weight data 162, weights for each ambisonic channel at each loudspeaker. Each weight at each loudspeaker represents an amount of a spherical harmonic corresponding to that ambisonic channel emitted by that loudspeaker. The weights may be determined from the sound data 132 and the loudspeaker position data 134.

The convolution manager 170 is configured to perform convolutions on the weight data 162 with the sum HRTF data 152 and the difference HRTF data 154 to produce sound fields in both left and right ears of the listener, i.e., left sound field data 172 and right sound field data 174. It turns out that the computations of both the left sound field data 172 and the right sound field data 174 involve the same sum HRTF data and difference HRTF data. In this way, there is only one convolution performed by the convolution manager 170 per channel, rather than two per channel according to conventional approaches.

In some implementations, the memory 126 can be any type of memory such as a random-access memory, a disk drive memory, flash memory, and/or so forth. In some implementations, the memory 126 can be implemented as more than one memory component (e.g., more than one RAM component or disk drive memory) associated with the components of the sound rendering computer 120. In some implementations, the memory 126 can be a database memory. In some implementations, the memory 126 can be, or can include, a non-local memory. For example, the memory 126 can be, or can include, a memory shared by multiple devices (not shown). In some implementations, the memory 126 can be associated with a server device (not shown) within a network and configured to serve the components of the sound rendering computer 120.

The components (e.g., modules, processing units 124) of the sound rendering computer 120 can be configured to operate based on one or more platforms (e.g., one or more similar or different platforms) that can include one or more types of hardware, software, firmware, operating systems, runtime libraries, and/or so forth. In some implementations, the components of the sound rendering computer 120 can be configured to operate within a cluster of devices (e.g., a server farm). In such an implementation, the functionality and processing of the components of the sound rendering computer 120 can be distributed to several devices of the cluster of devices.

The components of the sound rendering computer 120 can be, or can include, any type of hardware and/or software configured to process attributes. In some implementations, one or more portions of the components shown in the components of the sound rendering computer 120 in FIG. 1 can be, or can include, a hardware-based module (e.g., a digital signal processor (DSP), a field programmable gate array (FPGA), a memory), a firmware module, and/or a software-based module (e.g., a module of computer code, a set of computer-readable instructions that can be executed at a computer). For example, in some implementations, one or more portions of the components of the sound rendering computer 120 can be, or can include, a software module configured for execution by at least one processor (not shown). In some implementations, the functionality of the components can be included in different modules and/or different components than those shown in FIG. 1.

Although not shown, in some implementations, the components of the sound rendering computer 120 (or portions thereof) can be configured to operate within, for example, a data center (e.g., a cloud computing environment), a computer system, one or more server/host devices, and/or so forth. In some implementations, the components of the sound rendering computer 120 (or portions thereof) can be configured to operate within a network. Thus, the components of the sound rendering computer 120 (or portions thereof) can be configured to function within various types of network environments that can include one or more devices and/or one or more server devices. For example, the network can be, or can include, a local area network (LAN), a wide area network (WAN), and/or so forth. The network can be, or can include, a wireless network and/or wireless network implemented using, for example, gateway devices, bridges, switches, and/or so forth. The network can include one or more segments and/or can have portions based on various protocols such as Internet Protocol (IP) and/or a proprietary protocol. The network can include at least a portion of the Internet.

In some embodiments, one or more of the components of the sound rendering computer 120 can be, or can include, processors configured to process instructions stored in a memory. For example, the sound acquisition manager 130 (and/or a portion thereof), the HRTF acquisition manager 140 (and/or a portion thereof), the HRTF combination manager 150 (and/or a portion thereof), the decoding manager 160 (and/or a portion thereof), and the convolution manager 170 (and/or a portion thereof) can be a combination of a processor and a memory configured to execute instructions related to a process to implement one or more functions.

Figure 2:
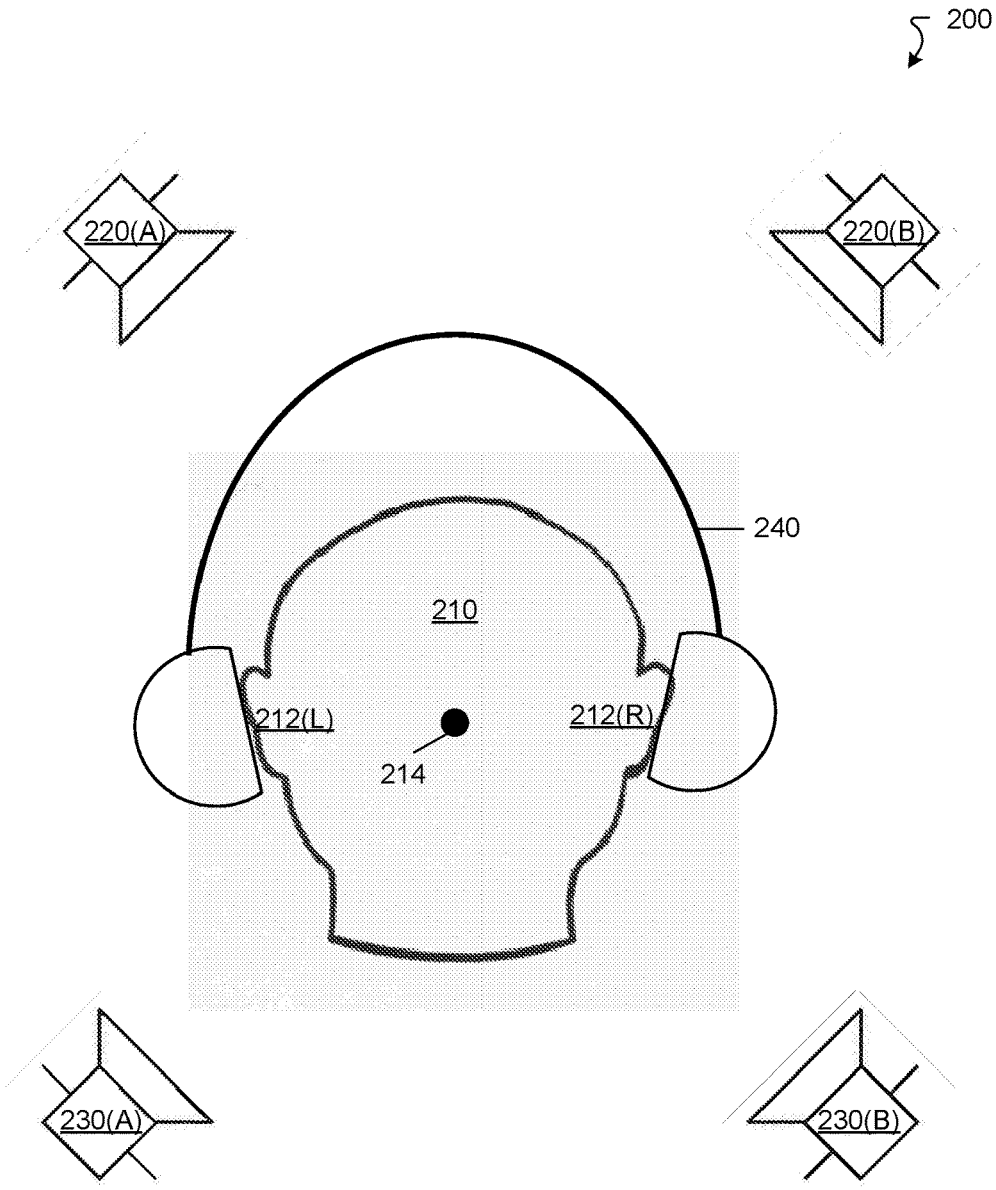
FIG. 2 is a diagram that illustrates an example sound field geometry according to the improved techniques described herein.

FIG. 2 illustrates an example sound field environment 200 according to the improved techniques. Within this environment 200, there is a listener whose head 210 has a left ear 212(L), a right ear 212(R), and a forward axis 214 (out of into the paper). The listener is wearing a pair of headphones 240. Surrounding the listener are a first pair of loudspeakers 220(A) and 220(B) placed symmetrically with respect to the forward axis 214 and a second pair of loudspeakers placed symmetrically with respect to the forward axis 214. In some implementations, the loudspeakers 220(A,B) and 230(A,B) are virtual loudspeakers that represent locations with respect to the listener from which the listener perceives sound as the listener wears the headphones 240.

Consider the loudspeakers 220(A,B) as being arranged equidistant from the listener. The frequency-space sound field A, B emanating respectively from the loudspeakers 220(A,B) is given as an expansion in spherical harmonics:

$$A(\theta, \phi, f) = \sum_{\ell=0}^{N} \sum_{m=-\ell}^{\ell} w^{(A)}_{\ell^2+\ell+m}(f) Y_{\ell m}(\theta, \phi), \tag{1}$$

$$B(\theta, \phi, f) = \sum_{\ell=0}^{N} \sum_{m=-\ell}^{\ell} w^{(B)}_{\ell^2+\ell+m}(f) Y_{\ell m}(\theta, \phi). \tag{2}$$

Note that $Y_{lm}(\theta,\phi)$ represents the (l,m) real spherical harmonic as a function of elevation angle θ and azimuthal angle ϕ. The totality of the real spherical harmonics form an orthonormal basis set over the unit sphere. However, truncated representations over a finite number, $(N+1)^2$, of ambisonic channels are considered herein. Also, the weights $w_k^{(A,B)}(f)$ are functions of frequency f and represent the weight data 162. In some implementations, the sound acquisition manager 130 (FIG. 1) acquires time-dependent weights and performs a Fourier transformation on, e.g., 1-second blocks of the weights to provide the frequency-space weights above.

It should be appreciated that the weights $w_k^{(A,B)}(f)$ are indexed in order according to the relation $k=l^2+l+m$. Conversely, a spherical harmonic order (l,m) may be determined from an ambisonic channel k according to $l=\lfloor\sqrt{k}\rfloor$, $m=k-l(l+1)$. These relations provide a unique, one-to-one mapping between a spherical harmonic order (l,m) and an ambisonic channel k.

As discussed previously, binaural rendering of the sound fields A (θ, ϕ, f) and B (θ, ϕ, f) in the left ear 212(L) and the right ear 212(R) is effected by performing a convolution operation on each of the sound fields with the respective left and right HRTFs of each of the loudspeakers. Note that a convolution operation over time is equivalent to a multiplication operation in frequency space. Accordingly, the sound fields in the left ear 212(L) L (i.e., the left sound field data 172) and right ear 212(R) R (i.e., the right sound field data 174) are as follows:

$$L(\theta, \phi, f) = \sum_{\ell=0}^{N} \sum_{m=-\ell}^{\ell} \left[ w^{(A)}_{\ell^2+\ell+m}(f) H_L^{(A)}(f) + w^{(B)}_{\ell^2+\ell+m}(f) H_L^{(B)}(f) \right] Y_{\ell m}(\theta, \phi), \tag{3}$$

$$R(\theta, \phi, f) = \sum_{\ell=0}^{N} \sum_{m=-\ell}^{\ell} \left[ w^{(A)}_{\ell^2+\ell+m}(f) H_R^{(A)}(f) + w^{(B)}_{\ell^2+\ell+m}(f) H_R^{(B)}(f) \right] Y_{\ell m}(\theta, \phi). \tag{4}$$

Because the speakers 220(A,B) are arranged symmetrically with respect to the forward axis 214, the sound fields will exhibit symmetric features. For example, the spherical harmonics $Y_{lm}(\theta,\phi)$ are symmetric about the forward axis 214 when m≥0 and are antisymmetric about the forward axis 214 when m<0. Further, we make the following assumptions about the sound fields:

(1) The head 210 is symmetric about the forward axis 214, (2) As discussed above, the loudspeakers 220(A) and 220(B) are arranged symmetrically about the forward axis 214, and (3) The decoding manager 160 (FIG. 1) produces, as weight data 162, antisymmetrical weights about the forward axis 214.

Assumptions (1) and (2) imply that $H_L^{(A)}(f)=H_R^{(B)}(f)$ and $H_R^{(A)}(f)=_L^{(B)}(f)$. Combining these equalities with the above identification of symmetric and antisymmetric ambisonic channels, the left and right sound fields may be written in a more useful form:

$$L(\theta, \phi, f) = \sum_{\ell=0}^{N} \left( \sum_{m=0}^{\ell} \left[ w^{(A)}_{\ell^2+\ell+m}(f) H_L^{(A)}(f) + w^{(B)}_{\ell^2+\ell+m}(f) H_R^{(A)}(f) \right] Y_{\ell m}(\theta, \phi) + \sum_{m=1}^{\ell} \left[ w^{(A)}_{\ell^2+\ell-m}(f) H_L^{(A)}(f) + w^{(B)}_{\ell^2+\ell-m}(f) H_R^{(A)}(f) \right] Y_{\ell,-m}(\theta, \phi) \right), \tag{1}$$

$$R(\theta, \phi, f) = \sum_{\ell=0}^{N} \left( \sum_{m=0}^{\ell} \left[ w^{(A)}_{\ell^2+\ell+m}(f) H_R^{(A)}(f) + w^{(B)}_{\ell^2+\ell+m}(f) H_L^{(A)}(f) \right] Y_{\ell m}(\theta, \phi) + \sum_{m=1}^{\ell} \left[ w^{(A)}_{\ell^2+\ell-m}(f) H_L^{(A)}(f) + w^{(B)}_{\ell^2+\ell-m}(f) H_L^{(A)}(f) \right] Y_{\ell,-m}(\theta, \phi) \right). \tag{2}$$

For each of the expressions above in Eqs. (1) and (2), the first inner sum represents the ambisonic channels that are symmetric about the forward axis 214 and the second inner sum represents the ambisonic channels that are antisymmetric about the forward axis 214.

(A) Assumption (3) implies that $w_{l^2+l+m}^{(A)}(f)=w_{l^2+l+m}^{(B)}(f)$ when m≥0 and $w_{l^2+l+m}^{(A)}(f)=w_{l^2+l+m}^{(B)}(f)$ when m<0. Then the above sums can be expressed solely in terms of contributions from one of the loudspeakers of the pair 220(A,B). When this simplification is taken, the sound fields in Eqs. (5) and (6) may be expressed in terms of a sum HRTF 152 and a difference HRTF 154:

$$L(\theta,\phi,f)=\sum_{\ell=0}^{N}\left(\sum_{m=0}^{\ell}\left[w^{(A)}_{\ell^2+\ell+m}(f)\left(H_L^{(A)}(f)+H_R^{(A)}(f)\right)\right]Y_{\ell m}(\theta,\phi)+\sum_{m=1}^{\ell}\left[w^{(A)}_{\ell^2+\ell-m}(f)\left(H_L^{(A)}(f)-H_R^{(A)}(f)\right)\right]Y_{\ell,-m}(\theta,\phi)\right), \quad (7)$$

$$R(\theta,\phi,f)=\sum_{\ell=0}^{N}\left(\sum_{m=0}^{\ell}\left[w^{(A)}_{\ell^2+\ell+m}(f)\left(H_L^{(A)}(f)+H_R^{(A)}(f)\right)\right]Y_{\ell m}(\theta,\phi)-\sum_{m=1}^{\ell}\left[w^{(A)}_{\ell^2+\ell-m}(f)\left(H_L^{(A)}(f)-H_R^{(A)}(f)\right)\right]Y_{\ell,-m}(\theta,\phi)\right). \quad (8)$$

Eqs. (7) and (8) together express the left sound field and the right sound field in terms of the same sum HRTF and difference HRTF. Thus, one need only form the sum HRTF $H_L^{(A)}(f)+H_R^{(A)}(f)$ and difference HRTF $H_L^{(A)}(f)-H_R^{(A)}(f)$ once for both the left sound field and the right sound field. The computation now involves the equivalent of a single convolution per ambisonic channel per sound field. This represents a factor of two improvement in computational efficiency over the conventional approaches which requires two convolutions per channel per sound field.

The above analysis applies to a single pair of loudspeakers 220(A,B). To include effects from other pairs of loudspeakers, e.g., loudspeakers 230(A,B), one repeats the above analysis and adds the resulting left sound fields and right sound fields to those computed above for the loudspeakers 220(A,B).

In some implementations, the loudspeakers 220(A,B) and 230(A,B) are virtual loudspeakers for which ambisonic equivalent panning (AEP) is to be applied. In this case, the weight data 162 may take the form of gain coefficients for each loudspeaker. For such gain coefficients, while the treatment differs slightly than that presented above, the resulting computational efficiency is the same.

Assume that, in an AEP application, the gain coefficients from each loudspeaker 220(A) $g^{(A)}(f)$ and 220(B) $g^{(B)}(f)$ may be expressed in terms of symmetric and antisymmetric components as follows:

$$g^{(A)}(f)=g_{sym}^{(A)}(f)+g_{antisym}^{(A)}(f),$$

$$g^{(B)}(f)=g_{sym}^{(B)}(f)+g_{antisym}^{(B)}(f).$$

The symmetry/antisymmetry conditions assumptions previously imply that $g_{sym}^{(A)}(f)=g_{sym}^{(A)}(f)$ and $g_{antisym}^{(A)}=-g_{antisym}^{(A)}(f)$. It then follows that, for each spherical harmonic, we need only consider the symmetric and antisymmetric gain coefficients from one of the pair of loudspeakers, e.g., 220(A):

$$g_{sym}^{(A)}(f)=\frac{1}{2}[g^{(A)}(f)+g^{(B)}(f)],$$

$$g_{antisym}^{(A)}(f)=\frac{1}{2}[g^{(A)}(f)-g^{(B)}(f)].$$

The sound field at each ear 212(L) and 212(R) associated with each pair of loudspeakers is then, for each spherical harmonic component, $$L(f)=g_{sym}^{(A)}(f)[H_L^{(A)}(f)+H_R^{(A)}(f)]+g_{antisym}^{(A)}(f)[H_L^{(A)}(f)-H_L^{(A)}(f)],$$

$$R(f)=g_{sym}^{(A)}(f)[H_L^{(A)}(f)+H_R^{(A)}(f)]+g_{antisym}^{(A)}(f)[H_L^{(A)}(f)-H_L^{(A)}(f)].$$

In some further implementations, AEP is carried out with multiple sound sources. In this case, symmetric and antisymmetric gain coefficients corresponding to a first sound source is stored in a buffer in memory. When the symmetric and antisymmetric gain coefficients corresponding to a second sound source are determined, these gain coefficients are added to the symmetric and antisymmetric gain coefficients stored in the buffer. The symmetric and antisymmetric gain coefficients stored in the buffer are then updated to take the values of these sums. This process may be carried out for any number of sound sources.

Figure 3:
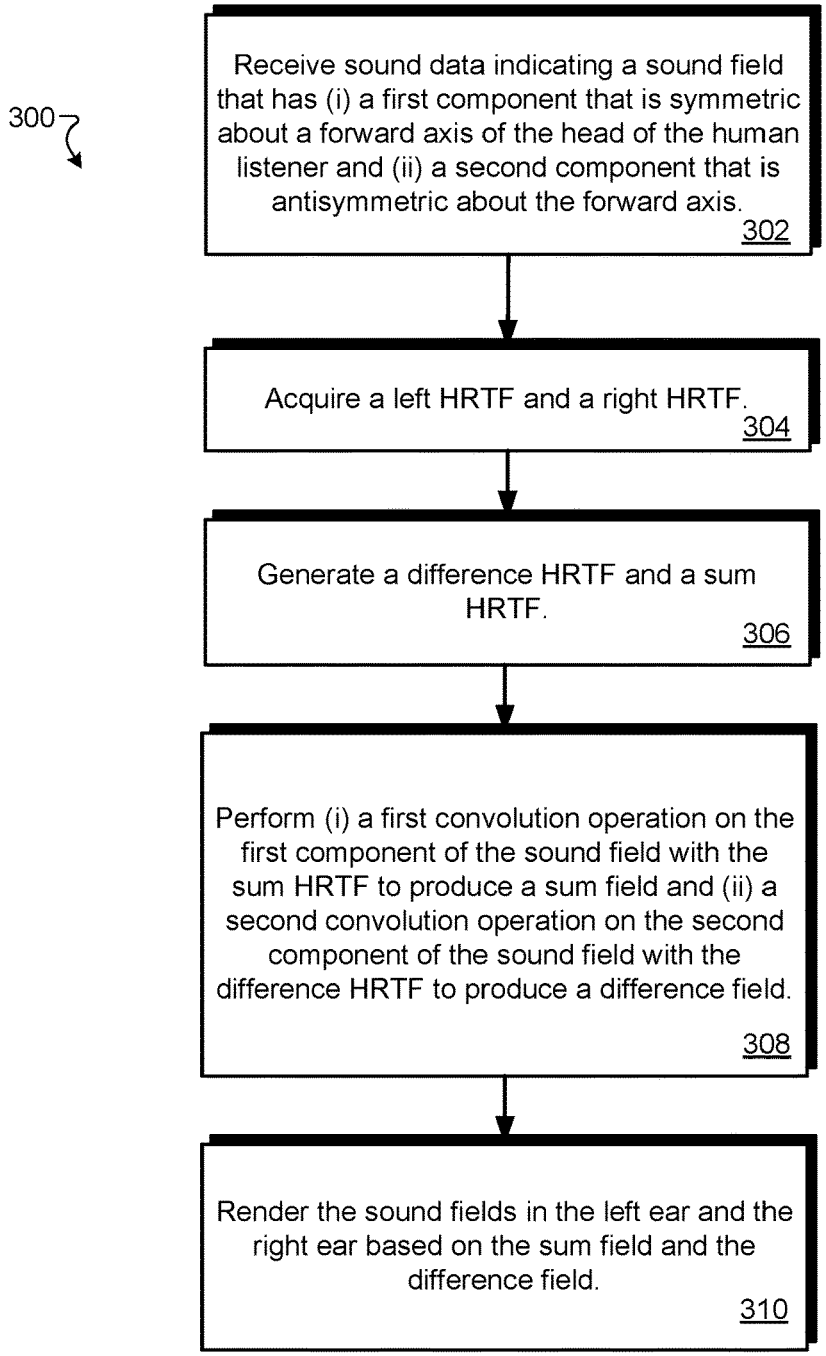
FIG. 3 is a flow chart that illustrates an example method of performing the improved techniques within the electronic environment shown in FIG. 1.

FIG. 3 is a flow chart that illustrates an example method 300 of performing binaural rendering of sound. The method 300 may be performed by software constructs described in connection with FIG. 1, which reside in memory 126 of the point cloud compression computer 120 and are run by the set of processing units 124.

At 302, controlling circuitry of a sound rendering computer configured to render sound fields in a left ear and a right ear of a head of a human listener receives sound data indicating a sound field that has (i) a first component that is symmetric about a forward axis of the head of the human listener and (ii) a second component that is antisymmetric about the forward axis.

At 304, the controlling circuitry acquires a left HRTF corresponding to the left ear and a right HRTF corresponding to the right ear.

At 306, the controlling circuitry generates (i) a difference HRTF as a difference between the left HRTF and the right HRTF and (ii) a sum HRTF as a sum of the left HRTF and the right HRTF.

At 308, the controlling circuitry performs (i) a first convolution operation on the first component of the sound field with the sum HRTF to produce a sum field and (ii) a second convolution operation on the second component of the sound field with the difference HRTF to produce a difference field.

At 310, the controlling circuitry renders the sound fields in the left ear and the right ear based on the sum field and the difference field.

Figure 4:
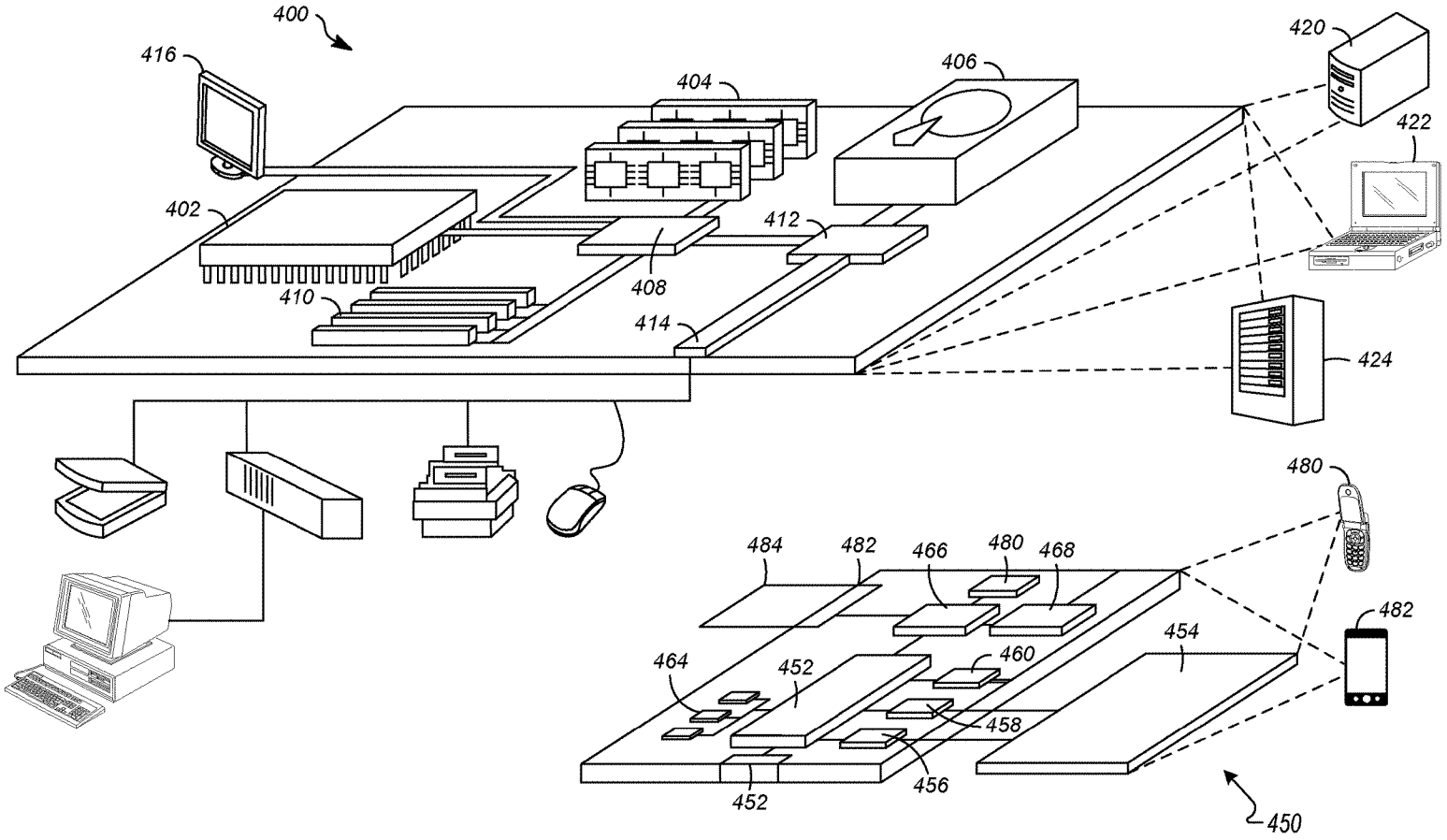
FIG. 4 illustrates an example of a computer device and a mobile computer device that can be used with circuits described here.

FIG. 4 illustrates an example of a generic computer device 400 and a generic mobile computer device 450, which may be used with the techniques described here.

As shown in FIG. 4, computing device 400 is intended to represent various forms of digital computers, such as laptops, desktops, workstations, personal digital assistants, servers, blade servers, mainframes, and other appropriate computers. Computing device 450 is intended to represent various forms of mobile devices, such as personal digital assistants, cellular telephones, smart phones, and other similar computing devices. The components shown here, their connections and relationships, and their functions, are meant to be exemplary only, and are not meant to limit implementations of the inventions described and/or claimed in this document.

Computing device 400 includes a processor 402, memory 404, a storage device 406, a high-speed interface 408 connecting to memory 404 and high-speed expansion ports 410, and a low speed interface 412 connecting to low speed bus 414 and storage device 406. Each of the components 402, 404, 406, 408, 410, and 412, are interconnected using various busses, and may be mounted on a common motherboard or in other manners as appropriate. The processor 402 can process instructions for execution within the computing device 400, including instructions stored in the memory 404 or on the storage device 406 to display graphical information for a GUI on an external input/output device, such as display 416 coupled to high speed interface 408. In other implementations, multiple processors and/or multiple buses may be used, as appropriate, along with multiple memories and types of memory. Also, multiple computing devices 400 may be connected, with each device providing portions of the necessary operations (e.g., as a server bank, a group of blade servers, or a multi-processor system).

The memory 404 stores information within the computing device 400. In one implementation, the memory 404 is a volatile memory unit or units. In another implementation, the memory 404 is a non-volatile memory unit or units. The memory 404 may also be another form of computer-readable medium, such as a magnetic or optical disk.

The storage device 406 is capable of providing mass storage for the computing device 400. In one implementation, the storage device 406 may be or contain a computer-readable medium, such as a floppy disk device, a hard disk device, an optical disk device, or a tape device, a flash memory or other similar solid state memory device, or an array of devices, including devices in a storage area network or other configurations. A computer program product can be tangibly embodied in an information carrier. The computer program product may also contain instructions that, when executed, perform one or more methods, such as those described above. The information carrier is a computer- or machine-readable medium, such as the memory 404, the storage device 406, or memory on processor 402.

The high speed controller 408 manages bandwidth-intensive operations for the computing device 400, while the low speed controller 412 manages lower bandwidth-intensive operations. Such allocation of functions is exemplary only. In one implementation, the high-speed controller 408 is coupled to memory 404, display 416 (e.g., through a graphics processor or accelerator), and to high-speed expansion ports 410, which may accept various expansion cards (not shown). In the implementation, low-speed controller 412 is coupled to storage device 406 and low-speed expansion port 414. The low-speed expansion port, which may include various communication ports (e.g., USB, Bluetooth, Ethernet, wireless Ethernet) may be coupled to one or more input/output devices, such as a keyboard, a pointing device, a scanner, or a networking device such as a switch or router, e.g., through a network adapter.

The computing device 400 may be implemented in a number of different forms, as shown in the figure. For example, it may be implemented as a standard server 420, or multiple times in a group of such servers. It may also be implemented as part of a rack server system 424. In addition, it may be implemented in a personal computer such as a laptop computer 422. Alternatively, components from computing device 400 may be combined with other components in a mobile device (not shown), such as device 450. Each of such devices may contain one or more of computing device 400, 450, and an entire system may be made up of multiple computing devices 400, 450 communicating with each other.

Computing device 450 includes a processor 452, memory 464, an input/output device such as a display 454, a communication interface 466, and a transceiver 468, among other components. The device 450 may also be provided with a storage device, such as a microdrive or other device, to provide additional storage. Each of the components 450, 452, 464, 454, 466, and 468, are interconnected using various buses, and several of the components may be mounted on a common motherboard or in other manners as appropriate.

The processor 452 can execute instructions within the computing device 450, including instructions stored in the memory 464. The processor may be implemented as a chipset of chips that include separate and multiple analog and digital processors. The processor may provide, for example, for coordination of the other components of the device 450, such as control of user interfaces, applications run by device 450, and wireless communication by device 450.

Processor 452 may communicate with a user through control interface 458 and display interface 456 coupled to a display 454. The display 454 may be, for example, a TFT LCD (Thin-Film-Transistor Liquid Crystal Display) or an OLED (Organic Light Emitting Diode) display, or other appropriate display technology. The display interface 456 may comprise appropriate circuitry for driving the display 454 to present graphical and other information to a user. The control interface 458 may receive commands from a user and convert them for submission to the processor 452. In addition, an external interface 462 may be provided in communication with processor 452, so as to enable near area communication of device 450 with other devices. External interface 462 may provide, for example, for wired communication in some implementations, or for wireless communication in other implementations, and multiple interfaces may also be used.

The memory 464 stores information within the computing device 450. The memory 464 can be implemented as one or more of a computer-readable medium or media, a volatile memory unit or units, or a non-volatile memory unit or units. Expansion memory 474 may also be provided and connected to device 450 through expansion interface 472, which may include, for example, a SIMM (Single In Line Memory Module) card interface. Such expansion memory 474 may provide extra storage space for device 450, or may also store applications or other information for device 450. Specifically, expansion memory 474 may include instructions to carry out or supplement the processes described above, and may include secure information also. Thus, for example, expansion memory 474 may be provided as a security module for device 450, and may be programmed with instructions that permit secure use of device 450. In addition, secure applications may be provided via the SIMM cards, along with additional information, such as placing identifying information on the SIMM card in a non-hackable manner.

The memory may include, for example, flash memory and/or NVRAM memory, as discussed below. In one implementation, a computer program product is tangibly embodied in an information carrier. The computer program product contains instructions that, when executed, perform one or more methods, such as those described above. The information carrier is a computer- or machine-readable medium, such as the memory 464, expansion memory 474, or memory on processor 452, that may be received, for example, over transceiver 468 or external interface 462.

Device 450 may communicate wirelessly through communication interface 466, which may include digital signal processing circuitry where necessary. Communication interface 466 may provide for communications under various modes or protocols, such as GSM voice calls, SMS, EMS, or MMS messaging, CDMA, TDMA, PDC, WCDMA, CDMA2000, or GPRS, among others. Such communication may occur, for example, through radio-frequency transceiver 468. In addition, short-range communication may occur, such as using a Bluetooth, WiFi, or other such transceiver (not shown). In addition, GPS (Global Positioning System) receiver module 470 may provide additional navigation- and location-related wireless data to device 450, which may be used as appropriate by applications running on device 450.

Device 450 may also communicate audibly using audio codec 460, which may receive spoken information from a user and convert it to usable digital information. Audio codec 460 may likewise generate audible sound for a user, such as through a speaker, e.g., in a handset of device 450. Such sound may include sound from voice telephone calls, may include recorded sound (e.g., voice messages, music files, etc.) and may also include sound generated by applications operating on device 450.

The computing device 450 may be implemented in a number of different forms, as shown in the figure. For example, it may be implemented as a cellular telephone 480. It may also be implemented as part of a smart phone 482, personal digital assistant, or other similar mobile device.

Various implementations of the systems and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms "machine-readable medium" "computer-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

To provide for interaction with a user, the systems and techniques described here can be implemented on a computer having a display device (e.g., a CRT (cathode ray tube) or LCD (liquid crystal display) monitor) for displaying information to the user and a keyboard and a pointing device (e.g., a mouse or a trackball) by which the user can provide input to the computer. Other kinds of devices can be used to provide for interaction with a user as well; for example, feedback provided to the user can be any form of sensory feedback (e.g., visual feedback, auditory feedback, or tactile feedback); and input from the user can be received in any form, including acoustic, speech, or tactile input.

The systems and techniques described here can be implemented in a computing system that includes a back end component (e.g., as a data server), or that includes a middleware component (e.g., an application server), or that includes a front end component (e.g., a client computer having a graphical user interface or a Web browser through which a user can interact with an implementation of the systems and techniques described here), or any combination of such back end, middleware, or front end components. The components of the system can be interconnected by any form or medium of digital data communication (e.g., a communication network). Examples of communication networks include a local area network ("LAN"), a wide area network ("WAN"), and the Internet.

The computing system can include clients and servers. A client and server are generally remote from each other and typically interact through a communication network. The relationship of client and server arises by virtue of computer programs running on the respective computers and having a client-server relationship to each other.

A number of embodiments have been described. Nevertheless, it will be understood that various modifications may be made without departing from the spirit and scope of the specification.

It will also be understood that when an element is referred to as being on, connected to, electrically connected to, coupled to, or electrically coupled to another element, it may be directly on, connected or coupled to the other element, or one or more intervening elements may be present. In contrast, when an element is referred to as being directly on, directly connected to or directly coupled to another element, there are no intervening elements present. Although the terms directly on, directly connected to, or directly coupled to may not be used throughout the detailed description, elements that are shown as being directly on, directly connected or directly coupled can be referred to as such. The claims of the application may be amended to recite exemplary relationships described in the specification or shown in the figures.

While certain features of the described implementations have been illustrated as described herein, many modifications, substitutions, changes and equivalents will now occur to those skilled in the art. It is, therefore, to be understood that the appended claims are intended to cover all such modifications and changes as fall within the scope of the implementations. It should be understood that they have been presented by way of example only, not limitation, and various changes in form and details may be made. Any portion of the apparatus and/or methods described herein may be combined in any combination, except mutually exclusive combinations. The implementations described herein can include various combinations and/or sub-combinations of the functions, components and/or features of the different implementations described.

In addition, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other embodiments are within the scope of the following claims.

What is claimed is:

1. A method, comprising:

receiving, by a sound rendering computer configured to render sound fields for presentation to a left ear and a right ear of a head of a human listener, sound data indicating a sound field that has (i) a first component that is symmetric about a forward axis of the head of the human listener and (ii) a second component that is antisymmetric about the forward axis, wherein the sound field is represented by a first virtual loudspeaker and a second virtual loudspeaker placed symmetrically about the forward axis, wherein receiving the sound data includes:

acquiring weights of ambisonic channels of the first virtual loudspeaker; and forming a first set of the weights of the ambisonic channels corresponding to those ambisonic channels that are symmetric about the forward axis and a second set of the weights of the ambisonic channels corresponding to those ambisonic channels that are antisymmetric with respect to the forward axis;

acquiring a left head-related transfer function (HRTF) corresponding to the left ear and a right HRTF corresponding to the right ear;

generating (i) a difference HRTF as a difference between the left HRTF and the right HRTF and (ii) a sum HRTF as a sum of the left HRTF and the right HRTF;

performing (i) a first convolution operation on the first component of the sound field with the sum HRTF to produce a sum field, wherein performing the first convolution operation on the first component of the sound field with the sum HRTF includes convolving the first set of weights with the sum HRTF and (ii) a second convolution operation on the second component of the sound field with the difference HRTF to produce a difference field, wherein performing the second convolution operation on the second component of the sound field with the difference HRTF includes convolving the second set of weights with the sum HRTF; and rendering the sound fields for presentation to the left ear and the right ear based on the sum field and the difference field.

2. The method as in claim 1, wherein rendering the sound fields for presentation to the left ear and the right ear includes performing (i) a sum operation on the sum field and the difference field to render a left sound field in the left ear and (ii) a difference operation on the sum field and the difference field to render a right sound field in the right ear.

3. The method of claim 1, wherein the generated difference HRTF is nonzero.

4. A method, comprising:

receiving, by a sound rendering computer configured to render sound fields for presentation to a left ear and a right ear of a head of a human listener, sound data indicating a sound field that has (i) a first component that is symmetric about a forward axis of the head of the human listener and (ii) a second component that is antisymmetric about the forward axis, wherein the sound field is emitted by a first loudspeaker and a second loudspeaker placed symmetrically about the forward axis, wherein receiving the sound data includes:

acquiring gain coefficients of the first loudspeaker and the second loudspeaker, each of the gain coefficients of the first loudspeaker and each of the gain coefficients of the second loudspeaker corresponding to a spherical harmonic; and from the gain coefficients of the first loudspeaker and the gain coefficients of the second loudspeaker, forming a first set of the gain coefficients corresponding to those spherical harmonics that are symmetric about the forward axis and a second set of the gain coefficients corresponding to those spherical harmonics that are antisymmetric with respect to the forward axis, acquiring a left head-related transfer function (HRTF) corresponding to the left ear and a right HRTF corresponding to the right ear;

generating (i) a difference HRTF as a difference between the left HRTF and the right HRTF and (ii) a sum HRTF as a sum of the left HRTF and the right HRTF;

performing (i) a first convolution operation on the first component of the sound field with the sum HRTF to produce a sum field, wherein performing the first convolution operation on the first component of the sound field with the sum HRTF includes convolving the first set of gain coefficients with the sum HRTF and (ii) a second convolution operation on the second component of the sound field with the difference HRTF to produce a difference field, wherein performing the second convolution operation on the second component of the sound field with the difference HRTF includes convolving the second set of gain coefficients with the sum HRTF; and rendering the sound field for presentation to the left ear and the right ear based on the sum field and the difference field.

5. The method as in claim 4, wherein forming the first set of the gain coefficients includes, for each spherical harmonic, generating an average of the gain coefficient of the first loudspeaker corresponding to that spherical harmonic and the gain coefficient of the second loudspeaker corresponding to that spherical harmonic, and wherein forming the second set of the gain coefficients includes, for each spherical harmonic, generating difference between the gain coefficient of the first loudspeaker corresponding to that spherical harmonic and the gain coefficient of the second loudspeaker corresponding to that spherical harmonic.

6. The method as in claim 4, wherein the sound field is provided by a plurality of sound sources, and wherein the method further comprises:

reading, from a memory of the sound rendering computer, a first net gain coefficient and a second net gain coefficient;

adding a gain coefficient of the first set of gain coefficients to the first net gain coefficient to produce a new first net gain coefficient;

adding a gain coefficient of the second set of gain coefficients to the second net gain coefficient to produce a new second net gain coefficient;

updating the first net gain coefficient with the new first net gain coefficient in the memory; and updating the second net gain coefficient with the new second net gain coefficient in the memory.

7. A computer program product comprising a non-transitory storage medium, the storage medium including code that, when executed by processing circuitry of a sound rendering computer configured to render sound fields for presentation to a left ear and a right ear of a head of a human listener, causes the processing circuitry to perform a method, the method comprising:

receiving sound data indicating a sound field that has (i) a first component that is symmetric about a forward axis of the head of the human listener and (ii) a second component that is antisymmetric about the forward axis, wherein the sound field is represented by a first virtual loudspeaker and a second virtual loudspeaker placed symmetrically about the forward axis, wherein receiving the sound data includes:

acquiring weights of ambisonic channels of the first virtual loudspeaker; and forming a first set of the weights of the ambisonic channels corresponding to those ambisonic channels that are symmetric about the forward axis and a second set of the weights of the ambisonic channels corresponding to those ambisonic channels that are antisymmetric with respect to the forward axis;

acquiring a left head-related transfer function (HRTF) corresponding to the left ear and a right HRTF corresponding to the right ear;

generating (i) a difference HRTF as a difference between the left HRTF and the right HRTF and (ii) a sum HRTF as a sum of the left HRTF and the right HRTF;

performing (i) a first convolution operation on the first component of the sound field with the sum HRTF to produce a sum, wherein performing the first convolution operation on the first component of the sound field with the sum HRTF includes convolving the first set of weights with the sum HRTF and (ii) a second convolution operation on the second component of the sound field with the difference HRTF to produce a difference field, wherein performing the second convolution operation on the second component of the sound field with the difference HRTF includes convolving the second set of weights with the sum HRTF; and rendering the sound fields for presentation to the left ear and the right ear based on the sum field and the difference field.

8. The computer program product as in claim 7, wherein rendering the sound fields for presentation to the left ear and the right ear include performing (i) a sum operation on the sum field and the difference field to render a left sound field in the left ear and (ii) a difference operation on the sum field and the difference field to render a right sound field in the right ear.

9. A computer program product comprising a non-transitory storage medium, the storage medium including code that, when executed by processing circuitry of a sound rendering computer configured to render sound fields for presentation to a left ear and a right ear of a head of a human listener, causes the processing circuitry to perform a method, the method comprising:

receiving sound data indicating a sound field that has (i) a first component that is symmetric about a forward axis of the head of the human listener and (ii) a second component that is antisymmetric about the forward axis, wherein the sound field is emitted by a first loudspeaker and a second loudspeaker placed symmetrically about the forward axis, wherein receiving the sound data includes:

acquiring gain coefficients of the first loudspeaker and the second loudspeaker, each of the gain coefficients of the first loudspeaker and each of the gain coefficients of the second loudspeaker corresponding to a spherical harmonic; and from the gain coefficients of the first loudspeaker and the gain coefficients of the second loudspeaker, forming a first set of the gain coefficients corresponding to those spherical harmonics that are symmetric about the forward axis and a second set of the gain coefficients corresponding to those spherical harmonics that are antisymmetric with respect to the forward axis, acquiring a left head-related transfer function (HRTF) corresponding to the left ear and a right HRTF corresponding to the right ear;

generating (i) a difference HRTF as a difference between the left HRTF and the right HRTF and (ii) a sum HRTF as a sum of the left HRTF and the right HRTF;

performing (i) a first convolution operation on the first component of the sound field with the sum HRTF to produce a sum field, wherein performing the first convolution operation on the first component of the sound field with the sum HRTF includes convolving the first set of gain coefficients with the sum HRTF and (ii) a second convolution operation on the second component of the sound field with the difference HRTF to produce a difference field, wherein performing the second convolution operation on the second component of the sound field with the difference HRTF includes convolving the second set of gain coefficients with the sum HRTF; and rendering the sound field for presentation to the left ear and the right ear based on the sum field and the difference field.

10. The computer program product as in claim 9, wherein forming the first set of the gain coefficients includes, for each spherical harmonic, generating an average of the gain coefficient of the first loudspeaker corresponding to that spherical harmonic and the gain coefficient of the second loudspeaker corresponding to that spherical harmonic, and wherein forming the second set of the gain coefficients includes, for each spherical harmonic, generating difference between the gain coefficient of the first loudspeaker corresponding to that spherical harmonic and the gain coefficient of the second loudspeaker corresponding to that spherical harmonic.

11. The computer program product as in claim 9, wherein the sound field is provided by a plurality of sound sources, and wherein the method further comprises:

reading, from a memory of the sound rendering computer, a first net gain coefficient and a second net gain coefficient;

adding a gain coefficient of the first set of gain coefficients to the first net gain coefficient to produce a new first net gain coefficient;

adding a gain coefficient of the second set of gain coefficients to the second net gain coefficient to produce a new second net gain coefficient;

updating the first net gain coefficient with the new first net gain coefficient in the memory; and updating the second net gain coefficient with the new second net gain coefficient in the memory.

12. An electronic apparatus configured to render sound fields for presentation to a left ear and a right ear of a head of a human listener, the electronic apparatus comprising:

memory; and controlling circuitry coupled to the memory, the controlling circuitry being configured to:

receive sound data indicating a sound field that has (i) a first component that is symmetric about a forward axis of the head of the human listener and (ii) a second component that is antisymmetric about the forward axis, wherein the sound field is represented by a first virtual loudspeaker and a second virtual loudspeaker placed symmetrically about the forward axis, wherein receiving the sound data includes:

acquiring weights of ambisonic channels of the first virtual loudspeaker; and forming a first set of the weights of the ambisonic channels corresponding to those ambisonic channels that are symmetric about the forward axis and a second set of the weights of the ambisonic channels corresponding to those ambisonic channels that are anti symmetric with respect to the forward axis;

acquire a left head-related transfer function (HRTF) corresponding to the left ear and a right HRTF corresponding to the right ear;

generate (i) a difference HRTF as a difference between the left HRTF and the right HRTF and (ii) a sum HRTF as a sum of the left HRTF and the right HRTF;

perform (i) a first convolution operation on the first component of the sound field with the sum HRTF to produce a sum field, wherein performing the first convolution operation on the first component of the sound field with the sum HRTF includes convolving the first set of weights with the sum HRTF and (ii) a second convolution operation on the second component of the sound field with the difference HRTF to produce a difference field, wherein performing the second convolution operation on the second component of the sound field with the difference HRTF includes convolving the second set of weights with the sum HRTF; and render the sound fields for presentation to the left ear and the right ear based on the sum field and the difference field.

13. The electronic apparatus as in claim 12, wherein the controlling circuitry configured to render the sound fields for presentation to the left ear and the right ear is further configured to perform (i) a sum operation on the sum field and the difference field to render a left sound field in the left ear and (ii) a difference operation on the sum field and the difference field to render a right sound field in the right ear.

14. An electronic apparatus configured to render sound fields for presentation to a left ear and a right ear of a head of a human listener, the electronic apparatus comprising:

memory; and controlling circuitry coupled to the memory, the controlling circuitry being configured to:

receive sound data indicating a sound field that has (i) a first component that is symmetric about a forward axis of the head of the human listener and (ii) a second component that is antisymmetric about the forward axis, wherein the sound field is emitted by a first loudspeaker and a second loudspeaker placed symmetrically about the forward axis, wherein the controlling circuitry configured to receive the sound data is further configured to:

acquire gain coefficients of the first loudspeaker and the second loudspeaker, each of the gain coefficients of the first loudspeaker and each of the gain coefficients of the second loudspeaker corresponding to a spherical harmonic; and from the gain coefficients of the first loudspeaker and the gain coefficients of the second loudspeaker, form a first set of the gain coefficients corresponding to those spherical harmonics that are symmetric about the forward axis and a second set of the gain coefficients corresponding to those spherical harmonics that are antisymmetric with respect to the forward axis, acquire a left head-related transfer function (HRTF) corresponding to the left ear and a right HRTF corresponding to the right ear;

generate (i) a difference HRTF as a difference between the left HRTF and the right HRTF and (ii) a sum HRTF as a sum of the left HRTF and the right HRTF;

perform (i) a first convolution operation on the first component of the sound field with the sum HRTF to produce a sum field, wherein performing the first convolution operation on the first component of the sound field with the sum HRTF includes convolving the first set of gain coefficients with the sum HRTF and (ii) a second convolution operation on the second component of the sound field with the difference HRTF to produce a difference field, wherein performing the second convolution operation on the second component of the sound field with the difference HRTF includes convolving the second set of gain coefficients with the sum HRTF; and render the sound field for presentation to the left ear and the right ear based on the sum field and the difference field.

15. The electronic apparatus as in claim 14, wherein the controlling circuitry configured to form the first set of the gain coefficients is further configured to, for each spherical harmonic, generate an average of the gain coefficient of the first loudspeaker corresponding to that spherical harmonic and the gain coefficient of the second loudspeaker corresponding to that spherical harmonic, and wherein the controlling circuitry configured to form the second set of the gain coefficients is further configured to, for each spherical harmonic, generate difference between the gain coefficient of the first loudspeaker corresponding to that spherical harmonic and the gain coefficient of the second loudspeaker corresponding to that spherical harmonic.

16. The electronic apparatus as in claim 14, wherein the sound field is provided by a plurality of sound sources, and wherein the controlling circuitry is further configured to:

read, from the memory, a first net gain coefficient and a second net gain coefficient;

add a gain coefficient of the first set of gain coefficients to the first net gain coefficient to produce a new first net gain coefficient;

add a gain coefficient of the second set of gain coefficients to the second net gain coefficient to produce a new second net gain coefficient;

update the first net gain coefficient with the new first net gain coefficient in the memory; and update the second net gain coefficient with the new second net gain coefficient in the memory.

* * * * *